United States Patent [19]

Benoun et al.

[11] 4,316,557

[45] Feb. 23, 1982

[54] BEVERAGE DISPENSER WITH REMOVABLE TANK CONNECTION MEANS

[75] Inventors: Samie Benoun, Sepulveda; Charles R. Lacy, Orange, both of Calif.

[73] Assignee: Sunkist Growers, Inc., Sherman Oaks, Calif.

[21] Appl. No.: 104,136

[22] Filed: Dec. 17, 1979

[51] Int. Cl.[3] ..... B67D 1/00

[52] U.S. Cl. ..... 222/129.1; 222/135; 222/325; 137/614.05

[58] Field of Search ..... 222/325, 129.1; 137/614.05; 141/353, 354, 375; 251/149.1, 149.7

[56] References Cited

U.S. PATENT DOCUMENTS

| | | | |
|---|---|---|---|
| 488,473 | 12/1892 | Fruen | 251/149.7 X |
| 1,831,028 | 11/1931 | Olson | 222/325 UX |
| 2,258,637 | 10/1941 | Young et al. | 222/325 |
| 2,433,977 | 1/1942 | Bently | 222/129.1 X |
| 2,453,080 | 11/1948 | Shimp | 141/375 X |
| 3,108,718 | 10/1963 | Seener | 222/129.1 |
| 3,625,251 | 12/1971 | Nelson | 137/614.05 X |
| 3,687,161 | 8/1972 | Grguric et al. | 137/614.05 X |
| 3,880,329 | 4/1975 | Gardner et al. | 222/325 X |
| 3,898,861 | 8/1975 | McMillin | 137/238 X |
| 3,915,341 | 10/1975 | Brown | 222/325 X |
| 3,930,598 | 1/1976 | Slagle | 222/325 X |

*Primary Examiner*—Robert J. Spar
*Assistant Examiner*—Frederick R. Handrem
*Attorney, Agent, or Firm*—Paul A. Weilein

[57] ABSTRACT

An improvement is described for beverage dispensers of the type having a housing, a valve spout for dispensing the liquid beverage, a pump for delivering the beverage to the valve spout and a tank replaceably disposed in the housing for containing the liquid beverage, the improvement consisting of a receptacle element being fixedly mounted upon the housing in order to locate a receiver for sliding engagement and disengagement with an outlet on the tank as the tank is disposed in the housing or removed therefrom. The receptacle element also includes an actuator for opening a check valve in the tank outlet and permitting communication of liquid beverage from the tank to the pump when the tank outlet is in engagement with the receiver of the receptacle element.

9 Claims, 4 Drawing Figures

FIG. 2.
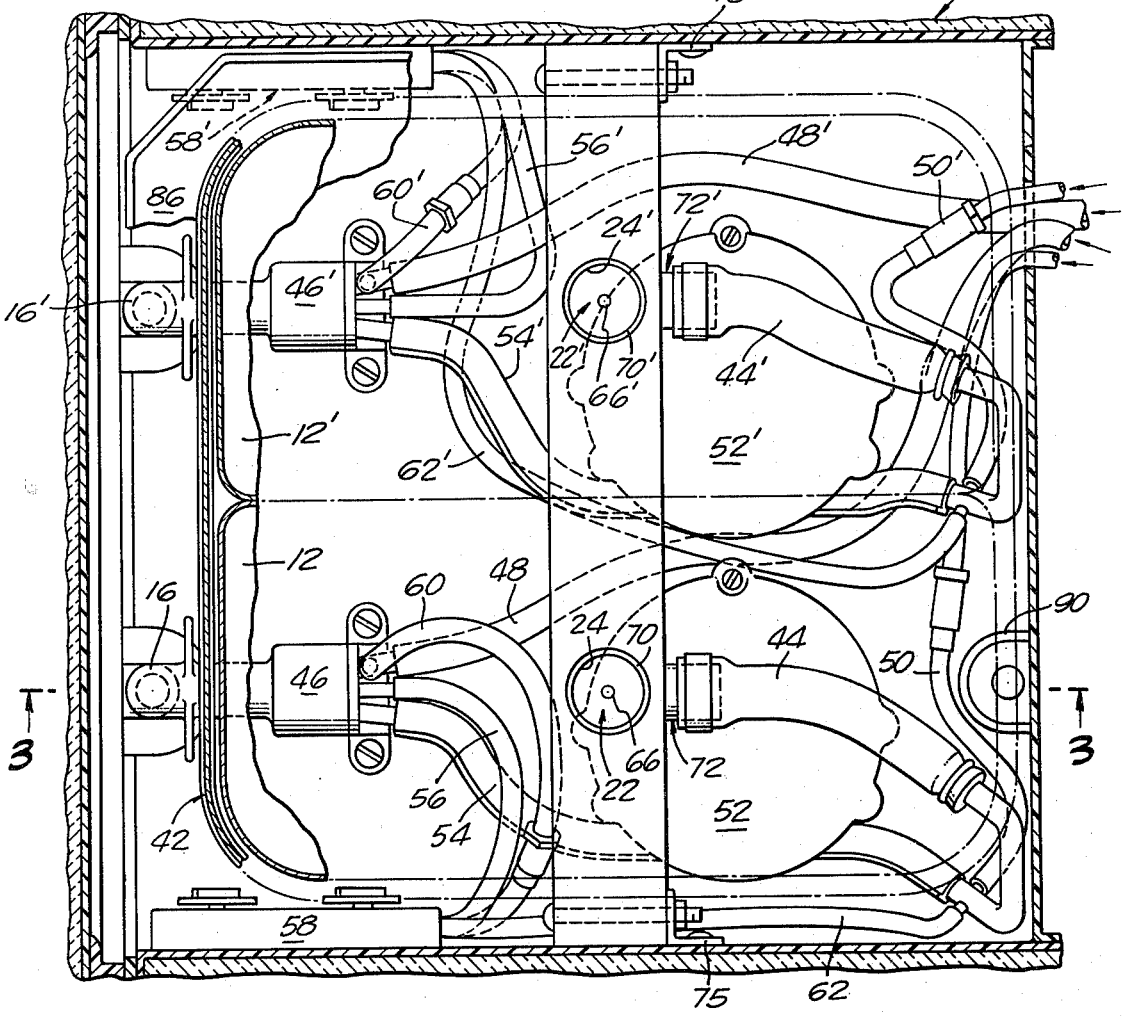
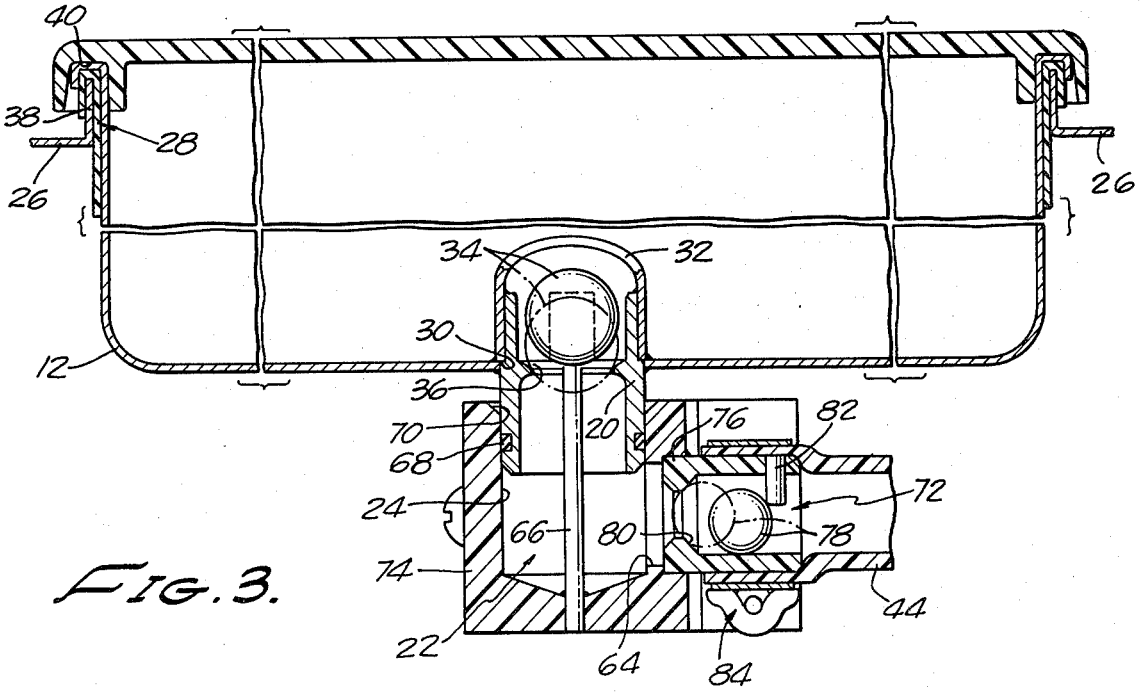
FIG. 3.

BEVERAGE DISPENSER WITH REMOVABLE TANK CONNECTION MEANS

BACKGROUND OF THE INVENTION

The present invention is directed toward beverage dispensers, for example, dispensers of the type used for blending concentrated fruit juices or the like with water in response to user demand. More particularly, the invention relates to an improved receptacle element for use in such beverage dispensers for assuring engagement and disengagement with an outlet on a beverage storage tank respectively during installation of the tank in the dispenser and upon removal of the tank from the housing, for example, when an empty tank is replaced with a tank filled with beverage or beverage concentrate.

A beverage dispenser of the general type contemplated by the present invention is described, for example, in U.S. Pat. No. 3,898,861, issued Aug. 12, 1975. Specific components or features for such a beverage dispenser are also disclosed, for example, by U.S. Pat. No. 3,995,441, issued Dec. 7, 1976; U.S. Pat. No. 3,865,134, issued Feb. 11, 1975; and U.S. Pat. No. 3,884,388, issued May 20, 1975. Beverage dispensers of the type disclosed by these patents are adapted for blending concentrated fruit juice with water in response to external actuation in order to produce a liquid beverage upon demand, usually in small quantities suitable for individual servings. Commonly, such dispensers provide two or more flavors of beverages such as fruit juice and, accordingly, have two separate tanks containing concentrated fruit juice and separate internal systems for supplying the concentrated fruit juice or syrup and water through suitable blenders or separate valve spouts having actuating means for regulating dispensation of the blended beverage at the command of a user. With the dispenser being particularly adapted for blending and dispensing fruit juice beverages, it is necessary to maintain the concentrated fruit juice at relatively low temperatures within the dispenser in order to prevent spoilage. In addition, it is commonly necessary to clean internal passages of the dispensers periodically, for example, on a daily basis.

In order to meet high volume demand for beverages as is common at lunch counters and the like, it is particularly important that the dispensers be designed to facilitate replacement of their beverage-containing tanks in order to assure a continuing supply of the fruit juice or other beverage. At the same time, it is also important to provide means for rapidly connecting and disconnecting the tanks from communication with internal portions of the dispenser in order to further facilitate replacement of the tanks and, at the same time, to eliminate or minimize spillage of the fruit juice or other beverage in order to maintain cleanliness of the dispensers.

In the past, the dispensers have commonly included flexible conduits which are adapted for rapid disconnection and reconnection to an outlet provided on the bottom of each storage tank. However, replacement of the storage tanks is often necessary at frequent intervals, particularly when there is high volume demand for beverages from the dispensers, as noted above. At such time, the storage tanks are often hastily removed from the dispenser resulting in separation of the conduit from internal dispenser components or breakage of the conduit itself, causing spillage of substantial amounts of the beverage within the dispenser housing. Such spillage is especially severe when concentrated fruit juices are contained within the tanks since they are particularly difficult to clean from the internal surfaces of the dispenser. At the same time, the concentrated fruit juice or syrup spilled within the dispenser may come in contact with operating components of the dispenser, including electrical or mechanical pump parts, and thus unduly increase the frequency for overhauling or replacing components within the dispenser.

Accordingly, there has been found to remain a need for improved tank mounting and connection means for beverage dispensers in order to facilitate rapid disconnection and reconnection of storage tanks in the dispensers while minimizing or eliminating spillage of beverage or beverage concentrates from the tanks.

SUMMARY OF THE INVENTION

It is therefore an object of the invention to provide improved connection means for the tanks of beverage dispensers of the type referred to above in order to facilitate replacement of the tanks and minimize or eliminate spillage of beverage or beverage concentrate.

More specifically, it is an object of the invention to provide an improved receptacle element for liquid beverage dispensers of the type having a housing, a valve spout for dispensing the beverage, internal means for delivering the liquid beverage to the valve spout and a tank, the tank being equipped with an outlet and removably disposed in the housing, the receptacle element being fixedly mounted upon the housing in order to position receiver means for sliding disengagement and engagement with the tank outlet as the tank is removed from the housing and replaced therein, the receptacle element also including means for permitting communication of liquid beverage from the tank only when the tank outlet is in engagement with the receiver means.

Preferably, the housing includes container means such as an opening in a wall portion thereof for receiving the storage tank in an accurately determined location, the receptacle element being secured to the dispenser housing so that the tank outlet moves along an axis of sliding engagement for the receiver means as the tank is installed into and removed from the opening defined by the housing.

It is also an object of the invention to provide such a receptacle element which may be used as a replacement part for dispensers of the type described below or alternateively may be used to modify prior art types of dispensers in accordance with the present invention.

Additional features of the invention are made apparent in the following description. For example, the receiver means and the outlet for the tank include seal means which are brought into engagement as the tank is properly positioned in the housing. The receptacle element is also of a preferred construction for facilitating access to internal portions thereof and for simplifying assembly and/or repair. As will be apparent from the following description, the present invention preferably contemplates a dispenser of the type adapted for flushing of the internal components and conduits which interconnect the receptacle element with the valve spout. A reverse check valve is provided adjacent the tank outlet in order to prevent the flushing solution from inadvertently entering and mixing with the beverage or concentrate in the tank. Construction of the receptacle element of the present invention is further simplified, by preferably forming the reverse check valve as an insert or integral portion of the receptacle element.

As will be described in greater detail below, the present invention particularly contemplates a beverage dispenser of the type adapted for storing two or more fruit juice concentrates and blending them, for example, with water in response to user demand. In such a dispenser, it is, of course, necessary to provide refrigeration means for maintaining the fruit juice concentrates at a low temperature and suitable means for flushing the pump and other internal components of the dispenser for sanitary purposes. However, it will be apparent that the improved receptacle element of the present invention may also be employed in other beverage dispensers.

Additional objects and advantages of the invention will be apparent from the following description having reference to the accompanying drawings.

BRIEF DESCRIPTION OF THE DRAWINGS

FIG. 2 is a plan view taken along section line 2—2 of FIG. 1, portions of the storage tanks within the dispenser housing being broken away to show other components of the dispenser;

FIG. 3 is a fragmentary view taken along section line 3—3 of FIG. 2 in order to better illustrate construction of the improved receptacle element and its location with respect to a replaceable tank in the dispenser.

DESCRIPTION OF THE PREFERRED EMBODIMENT

Figure 1:
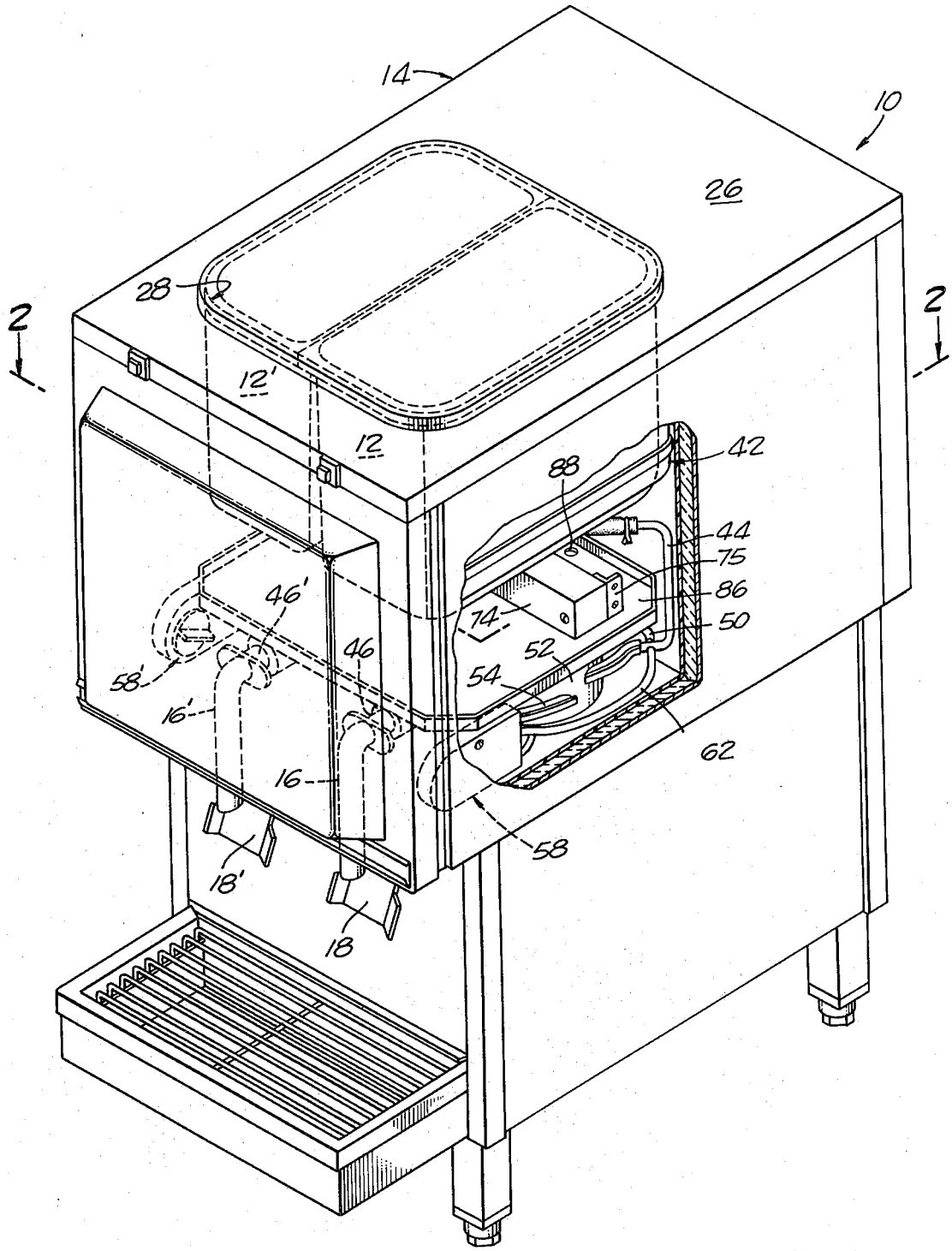
FIG. 1 is a perspective view of a beverage dispenser of the type contemplated by the present invention with portions being broken away in order to better illustrate internal construction of the dispenser.
Figure 4:
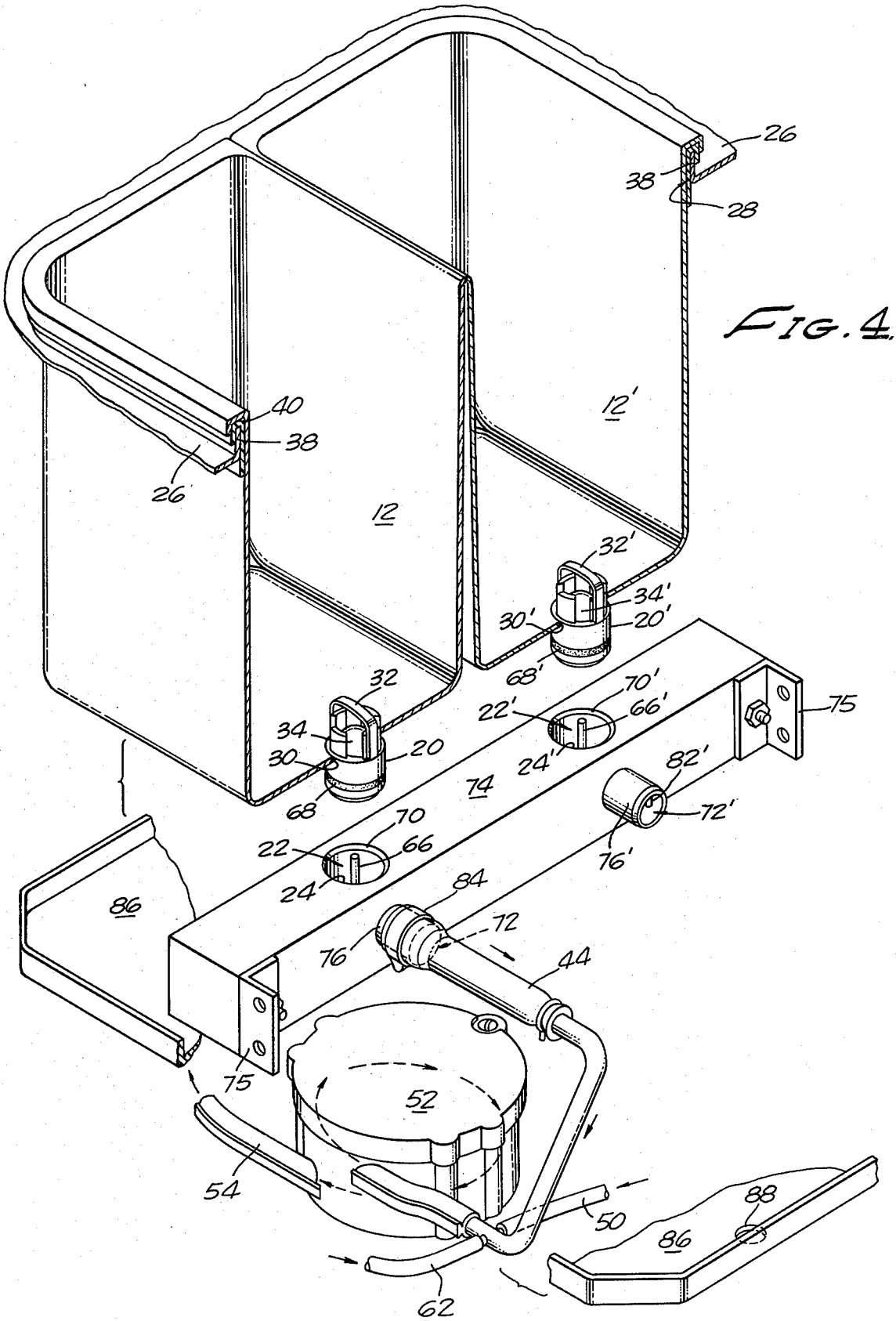
FIG. 4 is an exploded view of major components within the dispenser of FIG. 1 in order to particularly illustrate the association of the present improved receptacle element with the associated storage tank or tanks and internal components of the dispenser.

A beverage dispenser of the type contemplated by the present invention is indicated in FIG. 1. The dispenser illustrated in FIG. 1 and elsewhere in the drawings is adapted for dispensing two different beverages, for example, fruit juices of different flavors. However, the improved receptacle element of the present invention may also be employed in dispensers adapted for dispensing only a single beverage or even a greater number of beverages than two. The dispenser is presently in the form of a housing 10 for containing the various components described below.

In any event, for each beverage or flavor, the dispenser includes a separate storage tank 12 which is retained in an operative position in the housing by means of a suitable cover 14. The internal components for receiving the beverage may be best seen in FIG. 2, those components being described in greater detail below. In any event, the internal components of the dispenser communicate the beverages to separate valve spouts such as that indicated at 16 from which the beverage may be selectively drawn by actuating a dispensing lever 18.

As discussed above, the present invention is particularly concerned with providing an improved receptacle element for assuring positive engagement and disengagement of the storage tank 12 with the internal components of the dispenser upon replacement of the tank in the dispenser. In this regard, each storage tank 12 is equipped with an outlet 20 preferably arranged upon the bottom surface of the tank in order to permit gravity flow of the liquid contents of the tank through the outlet.

The improved receptacle element of the present invention is indicated at 22 and is best illustrated in FIG. 2 as being fixedly secured to the dispenser housing in order to locate a receiver 24 for sliding disengagement and engagement with the outlet 20 as the tank 12 is removed from the dispenser and replaced therein. Such replacement is common, for example, to provide a fresh supply of beverage or fruit juice concentrate. The manner in which the improved receptacle element of the present invention serves to facilitate removal and replacement of the storage tank while preventing or minimizing spillage of the liquid contents of the tank will be apparent from the following description. Generally, since the dispenser in the present invention is equipped with parallel arrangements for dispensing two different beverages or fruit juice flavors, only one of the parallel arrangements is described hereinbelow. The other parallel arrangement is indicated by similar primed numerals. In the following description, the major components of the dispenser are first described in order to better illustrate an exemplary setting for the improved receptacle element 22. Thereafter, the specific arrangement, function and construction of the receptacle element 22 will be described in order to permit a complete understanding of the invention.

Referring particularly to FIG. 1, the upper wall or surface 26 of the dispenser housing 10 is formed with an opening 28 which is only slightly larger than the two tanks 12 and 12' together in order to assure accurate location of the tanks within the dispenser. Each of the tanks, for example, that indicated at 12, has its outlet 20 preferably formed as a cylinder extending downwardly from an outlet port 30. A spider or cage 32 is mounted immediately above the outlet port 30 in order to retain a ball 34 adjacent a valve seat 36 formed within the cylindrical outlet element 20. The ball 34 and valve seat 36 provide a check valve function as will be described below.

Referring to FIG. 3, it may also be seen that the opening 28 is formed with a flange 38 which is received by a recess 40 formed about a periphery of each tank 12 in order to more accurately locate the tank 12 in the dispenser housing.

The other internal components of the dispenser are described only briefly below since they are described in greater detail by the references noted above. Initially, the dispenser housing 10 is equipped with a suitable refrigeration or cooling unit 42 which is adapted to maintain the contents of the storage tanks 12 and 12' at a suitably low temperature within the dispenser. Beverage components, preferably concentrate with some water, passes from the storage tank 12 through the receptacle element 22 described below and through a flexible conduit 44 to a valve block 46 having internal passages formed to suitably blend the juice or other beverage. Thereafter, it flows through the valve spout 16 in response to actuation of the dispensing lever 18.

Additional water is supplied to the dispenser under pressure through a main water conduit 48 and a flushing conduit 50. Concentrate from the conduit 44 is communicated to a pump 52 from where it is supplied under pressure through another conduit 54 to the valve block 46. Air is also supplied to the valve block 46 through an air conduit 56 in order to produce aeration or frothing in the beverage. The concentration of the beverage or fruit juice blended within the valve block 46 is controlled by a mixing device commonly referred to as a "Brix control" for establishing the instant ratio between the concentrate and water supplied through a conduit 54, the water supplied through the conduit 48 and the air supplied through the conduit 56. For this purpose, the adjustable mixing device indicated at 58 is in communication with the water conduit 48 by means of a branch conduit 60 and with the concentrate conduit 44 by means of a branch conduit 62. Thus, the mixing device 58 may be adjusted in order to regulate the final concentration of the beverage supplied through the valve spout 16.

As was noted above, it is necessary to flush the internal components of the dispenser to maintain sanitary conditions. For this purpose, the water supplied under pressure through the conduit 48 may be interrupted (by means not shown) and a suitable flushing solution directed through the conduit 50 which also forms a branch connection with the conduit 44 entering the inlet side of the pump 52. As the flushing solution passes through the conduit 50 under pressure and enters the concentrate conduit 44, the relatively high pressure thereby developed in the conduit 44 causes a reverse check valve 72, described in greater detail below in connection with the receptacle element 22, to close and prevent passage of the flushing solution into the storage tank 12. At the same time, the flushing solution circulates through the other internal components of the dispenser in order to maintain suitable standards of sanitation. After the flushing operation is complete, water under pressure is again supplied to the conduit 48 and water and concentrate from the conduit 44 pass through the pump 52 to be blended in the valve block 46 under control of the mixing device 58 as described above.

Referring now particularly to FIG. 3, the receptacle element 22 of the present invention serves a number of important functions within the present invention. Initially, it positions the receiver 24 in order to assure proper engagement and disengagement with respect to the outlet 20. At the same time, the receptacle element 22 provides an internal conduit 64 for communicating the tank outlet 20 with the conduit 44 when the tank is properly positioned within the dispenser housing. Furthermore, the receptacle element 22 also includes a vertically extending actuating pin 66 for automatically unseating the check valve ball 34 when the tank outlet 20 is properly positioned within the receiver 24. Referring particularly to FIG. 3, it may be seen that as the tank 12 is removed from the dispenser housing 10, the check valve ball 34 is immediately allowed to return to its seated position indicated in phantom in order to prevent spillage of liquid from the tank interior.

The receiver 24 is preferably a cylindrical opening slightly larger than the cylindrical tank outlet 20. A suitable seal or O-ring 68 is arranged about the tank outlet 20 for sealing engagement with the receiver 24. In addition, the upper edge of the cylindrical receiver 24 is tapered as indicated at 70 to provide a guide means for assuring proper alignment between the tank outlet 20 and the receiver 24.

Preferably, both the receptacle elements 22 and 22' for the two parallel systems of the dispenser are formed or disposed in a single elongated member or block which is generally indicated at 74. Brackets 75 arranged at each end of the block 74 are secured to the dispenser housing in order to accurately locate the receptacle elements 22 and 22'. The receivers 24 and 24' are thus located in spaced apart relation suitable for alignment with the outlets 20 and 20' of the two tanks 12 and 12' when they are arranged within the opening 28 of the dispenser housing. Otherwise, the receptacle element 22' includes the other components described immediately below with respect to the receptacle element 22. Referring again particularly to FIG. 3, the internal conduit 64 is preferably formed as an L-shaped continuation of the receiver 24, an insert 76 being secured in place relative to the block 74 and having one end in communication with the internal conduit 64. The insert 76 includes the reverse check valve 72 comprising a ball 78, valve seat 80 and pin 82 for limiting valve opening movement of the ball 78. It will be apparent that during normal operations of the dispenser, the ball 78 is in the position illustrated in solid lines so that concentrate may flow from the tank 12 into the conduit 44. However, upon the development of relatively high pressure in the conduit 44, as will exist, for example, during flushing operations, the ball 78 is urged upwardly against the valve seat 80, in the position illustrated in phantom in FIG. 3, to prevent reverse flow of liquid into the tank 12. Having continued reference to FIG. 3, the conduit 44 is secured in place upon the insert 76 by means of a clamp 84. A drip tray 86 is arranged immediately beneath the block 74 forming the two receptacle elements 22 and 22'. In the event that any liquid escapes from either of the tanks 12 or 12' and drips off of the block 74, it is trapped by the tray 86 and directed toward a drain 88 from which it passes into a suitable collection chamber 90 as may be best seen in FIG. 2.

It is believed that the manner of operation for the receptacle element in combination with the other components of the dispenser will be apparent from the preceding description. However, the operation is described briefly below in order to permit a complete understanding of the invention.

During dispensing operations of beverage or fruit juice through valve block 46 and valve spout 16 under regulation of the dispensing lever 18 and mixing device 58, the beverage or fruit juice concentrate from the tank 12 is allowed to flow through the outlet 20, the receiver 24 and the internal conduit 64 through the conduit 44 into the pump 52. The pump 52 is preferably of a peristaltic type designed to maintain sanitary conditions within the dispenser. In any event, the concentrate from the tank 12 is blended with water from the conduit 48 and air from the conduit 56 in the valve block 46 for dispensation through the valve spout 16 while the dispensing lever 18 remains actuated. With the tank 12 being in place within the dispenser housing 10, the actuating pin 66 maintains the ball check 34 in a raised position as illustrated in FIG. 3 so that the liquid concentrate from the tank may flow downwardly through the receptacle element.

When the concentrate is exhausted from the tank 12, the tank 12 is replaced by a new similar tank in order to replenish the supply of concentrate within the dispenser. At that time, the empty storage tank 12 may be lifted upwardly out of the opening 28 so that the cylindrical outlet 20 slides out of engagement with the receiver 24. At the same time, the check ball 34 is permitted to drop into closing engagement with the seal surface 36 in order to prevent undesired leakage of any remaining liquid from the tank. Thereafter, a filled tank 12 is lowered into place through the opening 28 which thus positions its outlet 20 in alignment with the receiver 24. As the tank 12 is lowered into the position best seen in FIG. 3, the actuating pin 66 urges the ball 34 upwardly in order to initiate communication between the tank 12 and the receptacle element 22. Seal engagement is simultaneously formed between the outlet 20 and the receiver 24 by means of the O-ring 68. Thereafter, the concentrate or beverage may be withdrawn from the tank 12 in the manner described above.

As was also noted above, operation of the dispenser may be periodically interrupted for cleaning operations. The flushing solution is prevented from entering the tank 12 by means of the reverse check valve 72. Thereafter, when flushing operations are discontinued, reduced pressure in the conduit 44 permits the ball 78 to move out of closed engagement with the valve seat 80 so that concentrate from the tank 12 may again flow into the conduit 44.

The use of the vertically extending pin 66 for actuation of the ball 34 provides a generally open passage through the receptacle element 22 which prevents accumulation of solid material such as pulp from the concentrated juices. Thus, the design of the receptacle element 22 is also particularly designed in order to assure continued operation of the dispenser.

Numerous modifications and variations will be apparent in addition to those described above. For example, the mating engagement between the outlet 20 and the receiver 24 may also be provided by different configurations. For example, the receiver 24 could be a cylindrical element sliding into sealing engagement within the interior of the cylindrical outlet 20. However, the configuration illustrated in FIG. 3 is preferred in order to permit maximum drainage of liquid from the interior of the tank 12. Similarly, the insert 76 could also be formed as an integral portion of the block 74. However, the separate formation of the insert 76 also permits selected replacement of the reverse check valve 72 if necessary. Other modifications will also be apparent from the preceding description. Accordingly, the scope of the present invention is defined only by the following appended claims.

What we claim is:

1. In a liquid beverage dispenser having a housing, a tank removably disposed in the housing and having a bottom outlet, a beverage dispensing valve spout, pumping means for delivering liquid beverage from the tank to the valve spout, and means for removably connecting the tank bottom outlet with said pump, the improvement comprising:

a cylindrical downwardly extending outlet element connected with said tank;

receptacle means fixedly mounted on said housing and having a cylindrical walled passage formed therein;

one end of said passage being adapted to slidingly engage and disengage said outlet element respectively during placement and removal of said tank, and the other end being adapted for connection with said pump;

a normally closed valve in said outlet element;

a valve at said other end of said passage for enabling flow from said connected tank to said pump, but preventing reverse flow; and means fixedly mounted in said passage and extending through said one end of said passage for opening said valve in the outlet element, when the outlet element is slidingly engaged by said one end of said passage.

2. The liquid beverage dispenser of claim 1 wherein the valves are ball check valves.

3. The liquid beverage dispenser of claim 2 in which the movement axis of the valve ball in the outlet element is substantially vertical, and the movement axis of the valve ball at said other end of said passage is substantially horizontal.

4. The liquid beverage dispenser of claim 3 in which the extent of movement of the valve ball at said other end of said passage away from its closed position is limited by a stop member.

5. The liquid beverage dispenser of claim 3 in which the valve ball at said other end of said passage occupies a slightly raised seated position with respect to its valve open position.

6. The liquid beverage dispenser of claim 1 wherein the cylindrical walled passage is L-shaped, and said fixedly mounted means comprises a pin having a lower end fixedly anchored in the wall of said passage.

7. The liquid beverage dispenser of claim 6 wherein said pin is anchored in the wall of a horizontal portion of said L-shaped passage and extends axially through a vertical portion thereof.

8. In a liquid beverage dispenser having a housing, a beverage containing tank removably disposed in the housing and having a bottom outlet, a beverage dispensing valve spout, and means for connecting the tank outlet with said spout, the improvement comprising:

a cylindrical downwardly extending outlet element connected with said tank;

a receptacle element fixedly mounted on said housing and having a cylindrical walled opening adapted to slidingly engage and disengage said outlet element respectively during placement and removal of said tank;

means for sealing the slidingly engaged cylindrical walled opening and said outlet element;

normally closed valve means in said outlet element;

a rigid pin fixedly mounted on said receptacle element and extending upwardly within said cylindrical walled opening, said pin being of a length to unseat and reseat said valve means respectively during said placement and removal of said tank, and while said cylindrical walled opening and said outlet member are in slidingly sealed engagement;

said cylindrical walled opening being connected with a side portion to form an L-shaped passage in the receptacle element, and said pin extending upwardly from a bottom wall surface of said cylindrical walled opening; and a normally open reverse flow check valve arranged in said side portion for preventing reverse flow through the cylindrical walled opening and said outlet element into the tank.

9. The liquid beverage dispenser of claim 8 wherein said reverse check valve comprises a ball check valve having a freely movable ball.

* * * * *